United States Patent [19]

Platt

[11] 4,201,264

[45] May 6, 1980

[54] SOLAR WATER TANK

[75] Inventor: Michael H. Platt, Corning, N.Y.

[73] Assignee: Owens-Illinois, Inc., Toledo, Ohio

[21] Appl. No.: 929,864

[22] Filed: Jul. 31, 1978

[51] Int. Cl.[2] ..... F28F 9/00

[52] U.S. Cl. ..... 165/162; 165/163

[58] Field of Search ..... 165/67, 68, 162, 163, 165/76, 132, 69, 104 S, 172, 178, 134, DIG. 8; 122/510; 126/400

[56] References Cited

U.S. PATENT DOCUMENTS

| | | | |
|---|---|---|---|
| 2,270,863 | 1/1942 | Barnes | 122/510 |
| 2,473,508 | 6/1949 | Collins | 165/67 |
| 2,530,519 | 11/1950 | Guggenheim | 165/163 |
| 2,865,612 | 12/1958 | Patton | 165/68 |
| 2,875,027 | 2/1959 | Dye | 165/162 |
| 3,268,989 | 8/1966 | Erwin et al. | 165/133 |
| 3,448,792 | 6/1969 | Lawrence | 126/400 |
| 4,030,540 | 6/1977 | Roma | 165/172 |
| 4,036,621 | 7/1977 | Burton | 165/172 |

FOREIGN PATENT DOCUMENTS

| | | | |
|---|---|---|---|
| 226749 | 9/1962 | Austria | 165/67 |
| 571275 | 12/1957 | Italy | 165/163 |

*Primary Examiner*—Sheldon Richter

*Attorney, Agent, or Firm*—John R. Nelson; Myron E. Click; David H. Wilson

[57] ABSTRACT

There is disclosed a solar water glass lined tank in which a copper tubing heat exchanger coil is installed and connected across inlet and outlet fittings of the tank. The circuit for circulation of a fluid which is to be heated or cooled is connected to these fittings for thermal exchange with fluid in the tank. Legs are secured to the tubing coil by flexible fasteners, such as plastic or plastic coated wire ties, and the tubing coil is installed in the tank prior to welding a head wall in place. The legs are spaced about the coil formation and extend from a sidewall, top-head corner junction of the tank. The legs are preferably of the same metal material as the coil and are cushioned at their ends with rubber or plastic bumpers. The head wall is welded in place and the tank is assembled for shipment and use.

8 Claims, 3 Drawing Figures

SOLAR WATER TANK

The present invention relates to a fluid tank in which a coil type heat exchanger is installed; and, more particularly, to a solar water, glass lined tank which is the storage vessel for solar heated hot water which immerses the heat exchanger coil.

BACKGROUND OF THE INVENTION

Tanks used in solar installations are illustrated in U.S. Pat. Nos. 4,027,821 and 4,044,754. In a drain-down or fully drainable solar energy collector system, it is important for good operation and efficiency to use a tank having a coil type heat exchanger to receive the solar heated water and to exchange that heat to a second fluid, such as domestic hot water, circulated through the coil heat exchanger.

In the construction of a tank of this type, the heat exchanger coil needs support against movement during shipment. Heretofore, the coils of the heat exchanger have been supported at the inlet/outlet fittings along the tank wall. Such mounting permits some movement of the coil in the tank. Heat exchanger coils of the type contemplated are usually provided with transverse, thin metallic fins which have sharp corners and are utilized to extend the area of the thermal transfer surface. Excessive movement of the coil within the tank may cause damage to the fragile glass lining of the tank or the fins of the tubing. Also, the tubing may become distorted or fractured resulting in either a restricted fluid flow through the coil in use or a failure. Since the coil is sealed within the tank, a failure of operation of the heat exchanger causes downtime of the system for repair or replacement of the tank.

SUMMARY OF THE INVENTION

The present invention provides an improvement in a typical glass lined hot water tank of a structure within the tank for supporting a coil type heat exchanger, thereby avoiding excessive movement of the coil in the tank in shipping alleviating damage to the glass lining, the heat exchanger fins or the coil itself.

The invention further provides such a support that is inexpensive to make and install, yet it is reliable and will inhibit galvanic corrosion within the tank elements.

The invention also provides a holder for the coil to inhibit excessive movement and includes legs constructed of the same material as the coil and shaped to each engage the top and bottom corners of the tank. The legs are fastened to the tubing of the coil at plural peripheral locations. The legs are shaped at spaced points with recesses therealong to nest the tubing of the heat exchanger in place. The legs are secured to the tubing by one or more flexible tie-style fasteners. The ends of the legs which engage the tank wall are provided with bumpers of a non-abrasive, non-scratching material, thereby avoiding damage to the fragile glass lining of the tank at the points where supporting engagement occurs.

Other advantages and features of the invention will become apparent from the following description and the accompanying drawings which are illustrative of a preferred embodiment of the invention herein claimed.

DESCRIPTION OF THE PREFERRED EMBODIMENT

Figure 2:
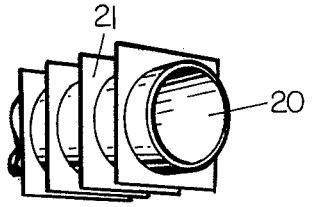
FIG. 2 is a fragmentary detail view in perspective of a portion of the metal tubing heat exchanger coil having metal radial fins thereon.
Figure 1:
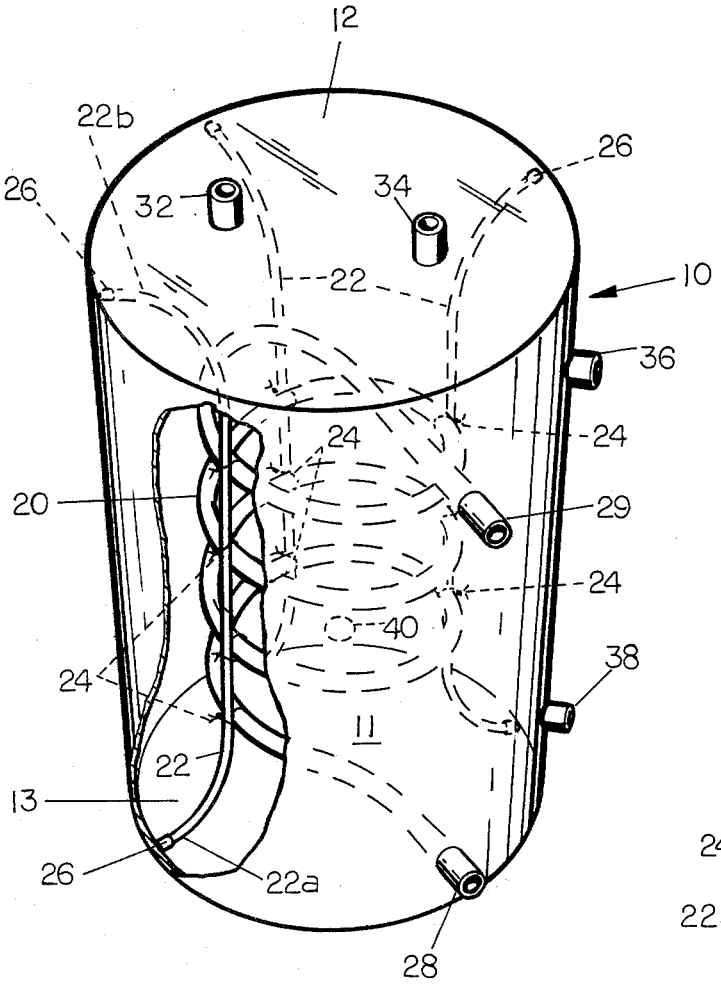
FIG. 1 is a perspective view of the glass lined solar water tank, partly broken away, illustrating the harness support for the coil type heat exchanger of the invention.

Referring to FIG. 1, a cylindrical metal tank 10 includes a cylindrical, continuous sidewall 11 of high strength steel that is fabricated, such as by welding, to a top head wall 12 and a bottom head wall 13, both made of a similar metal. As shown on FIG. 3, the bottom head wall 13 is concave and flanged at its periphery to fit at the end opening at the lower sidewall 11. The inside surface of tank 10 is glass lined such as illustrated at 14.

Initially, the tank 10 is fabricated with sidewall 11 and top head wall 12 welded together. The tank is lined usually with glass. The bottom head wall 13 is left unattached. A preshaped copper tubing heat exchanger coil 20 is placed inside the tank through the open bottom end. The coil 20 includes spaced apart, radial, metal fins 21 over much of its length to enhance heat transfer between a fluid in the coil tubing and the liquid in tank 10 in which the coil 20 is immersed.

Figure 3:
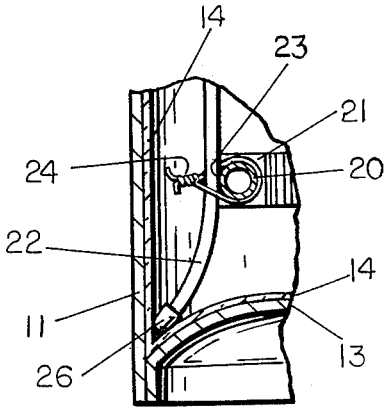
FIG. 3 is a fragmentary sectional elevational view of a lower corner portion of the tank of FIG. 1 which illustrates the positioning of one of the legs of the coil support harness, and tie down connections between the leg and the coil tubing of the heat exchanger.

In the assembly of coil 20, a support harness is attached to the coil, which is comprised of 2 or more legs 22. The legs are preferably formed from the same metal tubing material that is used in the make up of coil 20. On the drawings, three such legs 22 are shown, however, any number may be provided. The tubing for the legs are cut to length and flared (bent) outwardly near their opposite ends in their portions **22*a* and 22*b*. The flared extent and length of the legs is determined for the particular tank installation such that the opposite ends of the legs will fit in the seam between the ends of sidewall 11 of the tank and the top and bottom heads 12 and 13. Spaced along the legs 22 are formed concave recesses 23, which may be provided by flatening the tubing at spaced points to locate the coil turns on the leg for securing the two in position for easy assembly. Further, the recesses assure that the coil does not slide on the leg once restrained by flexible tie fasteners 24 (FIG. 3). The type of flexible tie fastener I prefer is the type often used in electrical industry because of its low cost and ease of assembly. The opposite ends of the legs 22 are fitted with bumpers 26** of a non-abrasive, non-scratching material, such as plastic or rubber. The end bumpers on the legs will prevent chipping or scratching the glass lining of the tank during and after installation. The bumpers also provide an insulator in service between dissimilar metals of the small tubes and the tank. This insulation will inhibit galvanic corrosion within the tank during service.

After the coil is assembled with the plural legs, as just described, and the two fabricated with the several flexible tie fasteners 24, the entire assembly of the coil heat exchanger and the harness (22, 24 and 26) is inserted through the open bottom of tank 10. The opposite ends of the coil tubing 20 are attached to the inlet fitting 28 and outlet fitting 29 along the wall of the tank. After this assembly, the bottom head wall 13 of the tank is inserted at the open bottom end and welded in place to complete the tank assembly.

Additionally, as is illustrated on the drawing of FIG. 1, the tank will include connections 32 and 34 for the introduction and withdrawal of solar heated fluid media. As is sometimes provided, FIG. 1 also shows two side fittings 36 and 38 for the attachment of a vertical sight glass to determine liquid elevation in tank 10 in service. And finally, as is often provided, the tank 10 is provided with a fitting 40 near the base of the tank complete with standard drain plug.

The embodiment of the invention just described provides a sturdy support for the heat exchanger coil assembly in the tank and such support system is simple and economical to construct and capable of trouble free service of the solar tank after shipment to a site for installation with a solar heating system. The support just described for the coil prevents excessive shifting and movement of the coil inside the tank, thereby avoiding damage to the fragile lining of the tank and damage or distortion to the elements of the coil heat exchanger.

While a specific embodiment including some of the detail of the invention has been described for illustrative purposes, and the best mode contemplated by the inventor is herein set forth, it is evident that various changes and modifications may be made without departing from the spirit of the invention. In the appended claims, it is intended that all changes and modifications for those given herein and incidental to the spirit of the invention are to be included as part of the invention.

Accordingly the following is claimed as the invention:

1. A liquid heat exchange tank having a continuous sidewall and top and bottom head walls fastened together to define a fluid type chamber, an inlet through one of said walls, an outlet through one of said walls, and a continuous heat exchanger coil of tubing disposed inside said chamber, the tubing thereof being connected outside of said chamber through said inlet and outlet, respectively, adapted for circulation of a fluid media through said coil of tubing, the improvement therein comprising plural legs inside the said chamber for bracing the heat exchanger coil and supporting it against excessive movement in said chamber, said legs being flared outwardly near their opposite ends and their opposite ends engaging the interior of the tank adjacent a juncture point between the sidewall and said top head wall and said bottom head wall, and means for fastening each of said plural legs to the heat exchanger coil at locations that are spaced from each other, whereby the said heat exchanger coil is provided with longitudinal and transverse support inside the tank independent of the inlet, outlet connections of the coil along the tank walls.

2. The heat exchange tank of claim 1 in which the plural legs are comprised of metal tubing and the coil is comprised of metal tubing, said metal tubing of each having similar properties for inhibiting galvanic corrosion in the tank.

3. The heat exchange tank of claim 1 or claim 2 in which the heat exchanger coil is comprised of copper tubing and said plural legs are each comprised of copper tubing.

4. The heat exchange tank of claim 3 in which the legs are shaped at locations to match the coil turns and nest thereon and the means fastening the legs to the coil comprise flexible ties secured around the coil and the leg.

5. The heat exchange tank of claim 4 in which the inner wall of the tank includes a fragile lining and the opposite ends of the said legs are protected by end bumpers thereon, said end bumpers engaging said tank wall and are each comprised of a non-abrasive, non-scratching material to avoid damage to said fragile lining.

6. The heat exchange tank of claim 5 in which the end bumpers on said legs are made of material selected from the group consisting of plastic and rubber.

7. The heat exchanger tank of claim 1 or 2 in which the inner wall of the tank includes a fragile lining and the opposite ends of the said legs are protected by end bumpers thereon, said end bumpers engaging said tank wall and are each comprised of a non-abrasive, non-scratching material to avoid damage to said fragile lining.

8. The heat exchange tank of claim 7 in which the end bumpers on said legs are made of material selected from the group consisting of plastic and rubber.

* * * * *